United States Patent [19]

Dean et al.

[11] 4,442,428

[45] Apr. 10, 1984

[54] COMPOSITE VIDEO COLOR SIGNAL GENERATION FROM DIGITAL COLOR SIGNALS

[75] Inventors: Mark E. Dean, Boynton Beach; David A. Kummer, Boca Raton; Jesus A. Saenz, Coral Springs, all of Fla.

[73] Assignee: IBM Corporation, Armonk, N.Y.

[21] Appl. No.: 292,074

[22] Filed: Aug. 12, 1981

[51] Int. Cl.[3] ..... G09G 1/28

[52] U.S. Cl. ..... 340/703; 340/749; 358/10; 358/81

[58] Field of Search ..... 340/749, 744, 741, 703; 358/10, 81, 82

[56] References Cited

U.S. PATENT DOCUMENTS

| | | | |
|---|---|---|---|
| 3,510,865 | 5/1970 | Callahan et al. | 340/741 |
| 3,944,999 | 3/1976 | Moore | 340/703 |
| 4,093,960 | 6/1978 | Estes | 358/10 |
| 4,139,838 | 2/1979 | Inose et al. | 340/703 |
| 4,155,095 | 5/1979 | Kirschner | 340/703 |
| 4,217,604 | 8/1980 | Wozniak | 358/82 |
| 4,342,029 | 7/1982 | Hofmanis et al. | 340/703 |

*Primary Examiner*—Marshall M. Curtis

*Attorney, Agent, or Firm*—Sughrue, Mion, Zinn, MacPeak & Seas

[57] ABSTRACT

A 3.58 MHz subcarrier signal and a 14.318 MHz clock signal are applied to three flipflops (50, 52 and 54) in such a manner that there appears on the output terminals (Q and $\overline{Q}$) of the latches individual phase-shifted subcarriers having relative phases of 0°, 180°, 90°, 270°, 135° and 315° , respectively, representing the colors yellow, blue, red, cyan, magenta and green, respectively. Computer-generated digital color signals (+BLUE, +GREEN, +RED) are applied to the switching inputs (A, B, C) of a multiplexer (56) in order selectively to switch to the output of the multiplexer individual ones of the phase-shifted subcarriers in accordance with the code represented by the digital color signals. The individual subcarriers are combined in a summing circuit (62, 64) with television synchronizing and blanking pulses to produce a composite video color signal which is directly compatible with a conventional composite monitor and, after R.F. modulation, with a conventional television receiver. Brighter versions of the colors are obtained by increasing the direct current level (+INTENSITY) at the summing circuit.

4 Claims, 3 Drawing Figures

COMPOSITE VIDEO COLOR SIGNAL GENERATION FROM DIGITAL COLOR SIGNALS

TECHNICAL FIELD

This invention relates generally to the conversion of digital red, blue and green signals into a full color composite video signal compatible with conventional television receivers and monitors designed in accordance with the standards set up by the National Television Standards Committee (NTSC). More particuarly, the invention relates to a method and circuit for accurately converting computer-generated color digital signals into a full color composite video signal containing the NTSC color subcarrier, phase- shifted relative to a reference color burst to produce a display of a color in accordance with the digital color signals.

BACKGROUND OF THE INVENTION

It is known that the phase of the color subcarrier signal relative to the color reference burst of a video signal determines the hue or color of the image displayed on a television receiver or monitor. Furthermore, there exist in the prior art many methods and circuits for combining the red, blue and green video color signals to produce resultant composite video color signals for displaying images having colors which are combinations of these three colors. For example, the prior art systems have attempted to generate phase-shifted signals by delay lines, but poor colors were produced because it was difficult accurately to control the phase angles of the various signals. Furthermore, there exists a prior art system in which color switching signals operate a multiplexer to which the color subcarrier and an inverted color subcarrier are applied to produce signals which are applied to a pair of analog phase shifters, such as resonant RLC circuits, whose phase-shifted sinusoidal outputs are electrically summed to produce a resultant color signal; however, such a system requires an analog phase shifter which is both expensive and space-consuming. The following U.S. Pat. Nos. are representative of such prior art: 4,040,086; 4,139,863; 4,149,184; and 4,155,095.

SUMMARY OF THE INVENTION

The present invention provides a method and circuit for digitally and directly converting digital red, blue and green color signals into a full color composite video signal without the need for analog components and without the need for summing component color signals in order to obtain a desired resultant color signal.

In accordance with the preferred embodiment of the invention, this result is achieved by using a plurality of digital delay devices to generate a plurality of discrete color subcarrier signals individually phase-shifted relative to the color burst. The discrete subcarrier signals are applied to a multiplexer and selectively and individually outputted therefrom under the control of computer-generated red, blue and green digital color signals. Each output color signal is then summed with other video signal components to produce the composite video color signal which may be transmitted to a conventional color television receiver or monitor.

For a better understanding of the present invention, together with other and further advantages and features thereof, reference is made to the following description taken in connection with the accompanying drawings, the scope of the invention being pointed out in the appended claims.

DETAILED DESCRIPTION OF THE PREFERRED EMBODIMENT

Figure 1:
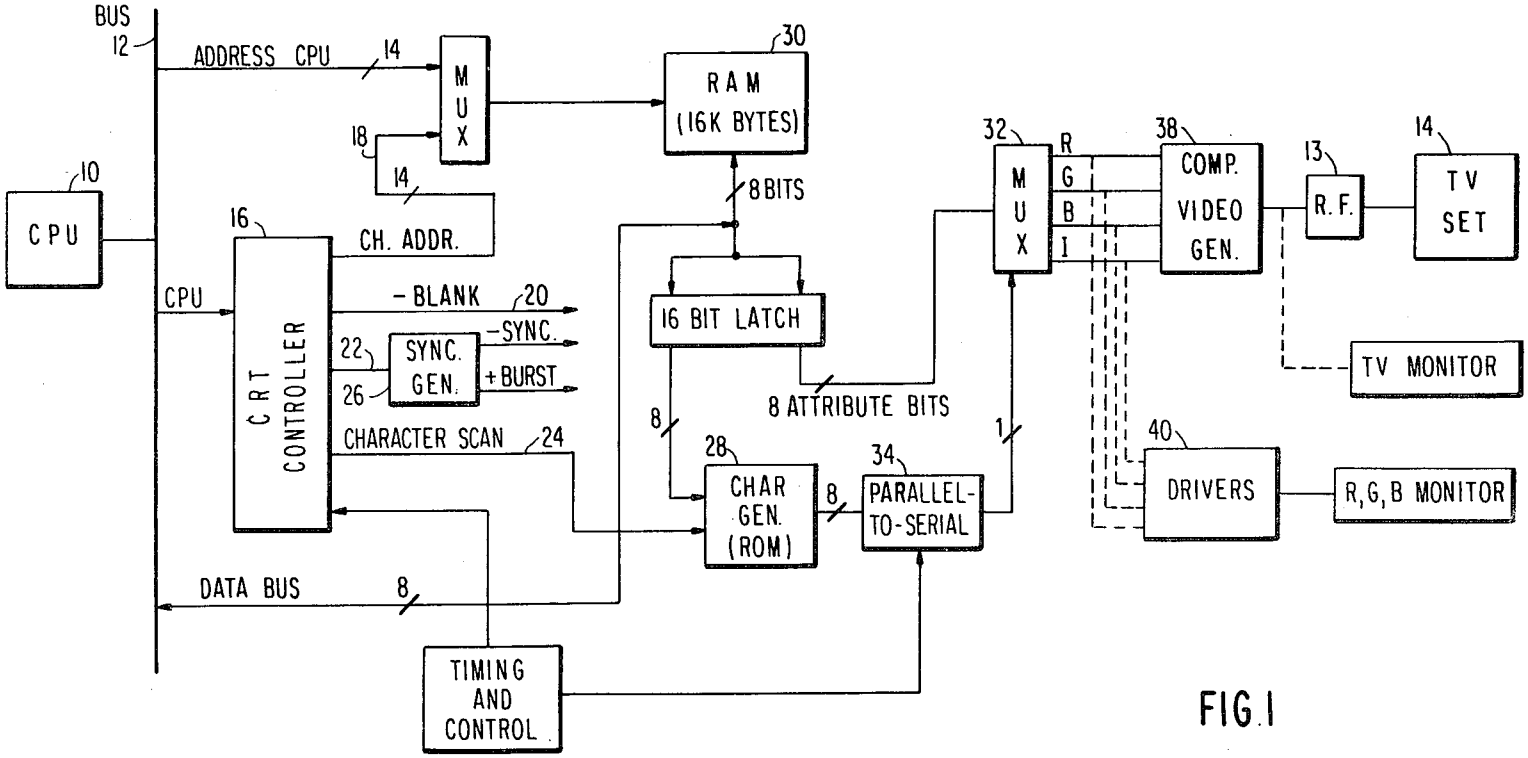
FIG. 1 is a generalized block diagram of a data processing system, such as a personal computer, in which the present invention has particular utility.

FIG. 1 is a block diagram of a portion of a data processing system, such as a personal computer, in which alpha/numeric and graphic data, generated by a keyboard or other components of the system, are displayed on a cathode ray tube, such as a conventional television receiver or monitor.

Figure 3:
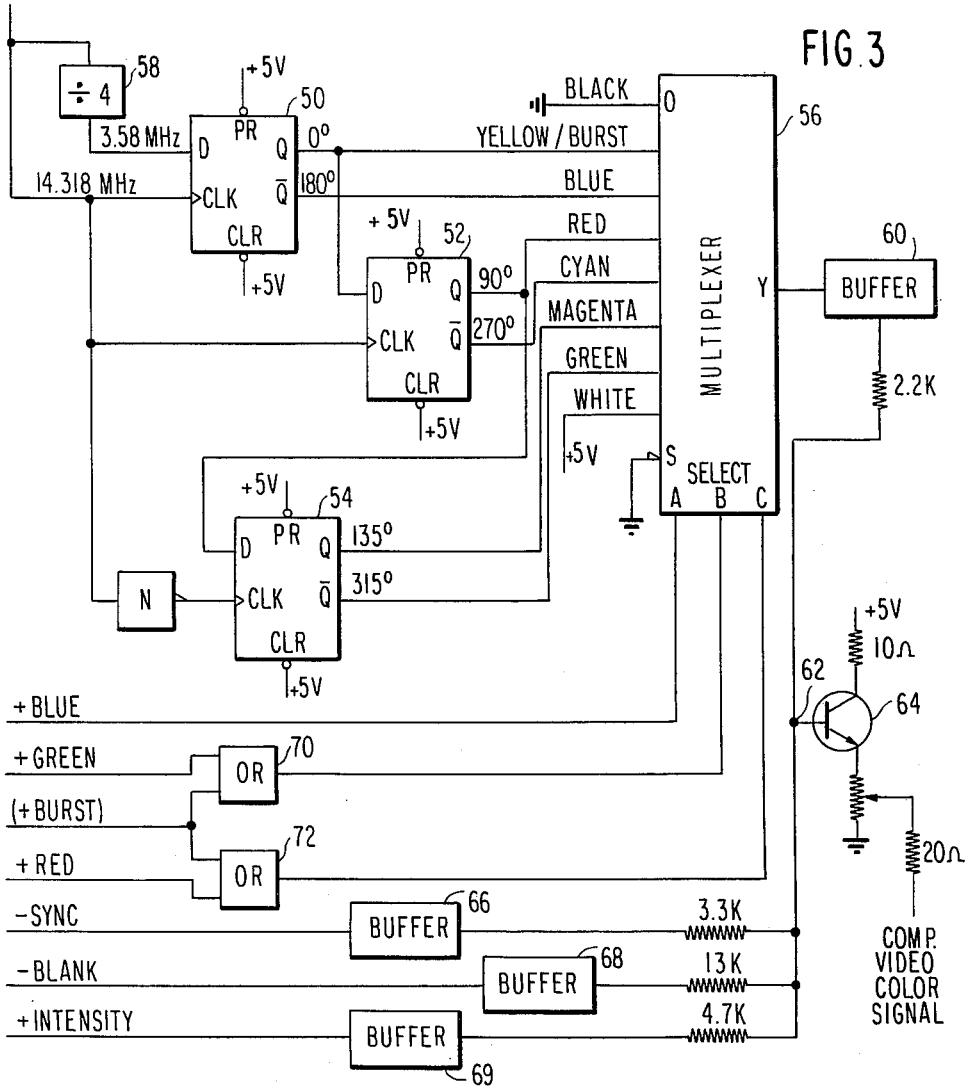
FIG. 3 is a combined logic and circuit schematic diagram illustrating the preferred embodiment of the invention.

Such a system is one example of a source for the various signals applied to the novel composite video generator 38 whose details are illustrated in FIG. 3.

A central processing unit (CPU) 10 is connected to a three-state system bus 12 including an 8-bit data bus. Let us assume that a character, such as one entered by a keyboard coupled to the bus, is to be displayed on the cathode ray tube (CRT) of a conventional TV receiver 14. A conventional CRT controller 16, such as a Motorola 6845 chip, controlled by CPU 10 via the bus 12, generates the CHARACTER ADDRESS on output lines 18, CHARACTER SCAN on lines 24, and the television frequency components on lines 20 and 22. There are produced on output line 22 the horizontal and vertical synchronizing pulses which are applied to a sync generator 26 which produces −SYNC and +BURST signals. A −BLANK signal is produced on line 20, and the scanning pulses are produced on line 24 and applied to a character generator (ROM) 28. An 8-bit character code is fetched from a random access memory (RAM) 30 at the specified character address. An 8-bit attribute code is also fetched, and four of these bits designate the color of the character to be displayed, i.e. the foreground color of the character, as opposed to the background color of the character. The four character color bits are applied to a multiplexer (MUX) 32, such as a 74LS157 chip, which outputs the red (R), green (G), blue (B) and intensity (I) signals from which there is derived the composite video color signal to be applied to the TV receiver. Multiplexer 32 is under the control of the serial character dots from the 8-to-1 parallel-to-serial converter 34 connected to the output of the character generator 28. The digital R, G, B and I signals on the output of multiplexer 32 are applied as inputs to a composite video generator 38 which produces the composite video color signal which can be used directly by a conventional composite monitor or, after being modulated by an R.F. modulator 13, by TV receiver 14 to display the colored character, or as inputs to the drivers 40 of a conventional direct drive TV monitor which operates directly from the R, G, B and I signals without the RF modulation required by the TV receiver 14, but which requires externally supplied synchronizing and blanking signals.

The composite video generator 38 in FIG. 1 is the subject of the present invention.

Figure 2:
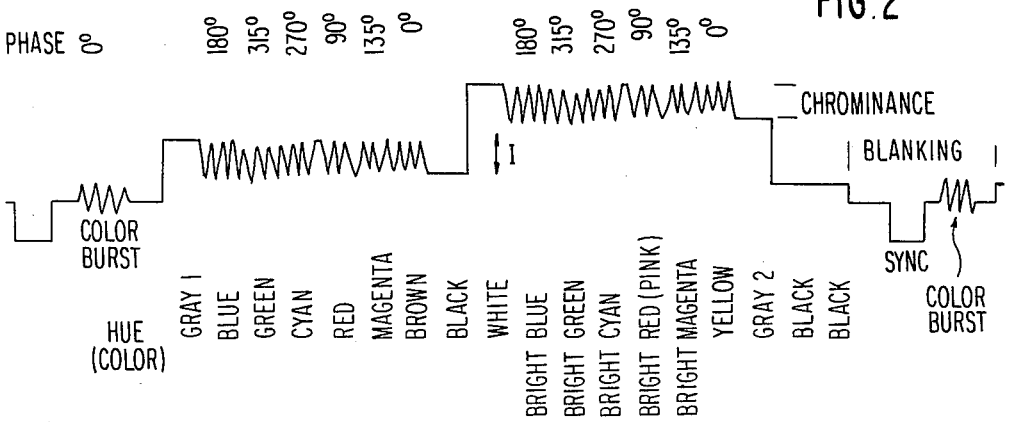
FIG. 2 is a generalized composite video color signal showing the components of such a signal and diagrammatically illustrating the colors and corresponding phase angle provided by this invention.

As shown in FIG. 2, the composite video color signal applied to the TV receiver 14 consists of four parts: the luminance, the hue (color), the chrominance and the color reference burst on the back porch of the sync signal. The luminance is the D.C. level of the composite signal and determines the brightness of the color. The luminance also contains the sync information and is compatible with the conventional black and white video signal. The hue or color is determined by the phase of the NTSC 3.58 MHz color signal with respect to the reference color BURST signal. The chrominance is the amount of white in, or the degree of saturation of, the color and is determined by the amplitude of the 3.58 MHz subcarrier at each phase. The color burst is a burst of 8 to 10 cycles of the 3.58 MHz subcarrier on the back porch of each horizontal sync; this burst provides the reference phase (zero) for the 3.58 MHz subcarrier. The hue is determined by the difference in phase between the color burst and the 3.58 MHz color subcarrier.

FIG. 2 shows a color composite signal for the colors provided in this invention wherein the chrominance is always fixed and the luminance (I) and hue (phase) are varied.

FIG. 3 is a logic and schematic circuit diagram of the novel composite video generator 38 of FIG. 1, and functions directly to convert the R, G, B and I digital color signals on the output of MUX 32 to a composite video color signal which can be utilized by the TV receiver 14 to display the character image having the color designated by a particular set of digital color signals. In the following description, a line is UP, i.e. has a logical value of 1 (+5 volts), when the indicated signal is present, and is DOWN, i.e. has the logical value of 0 (0 volts), when that signal does not exist.

The circuit of FIG. 3 consists of three digital delay devices in the form of three 74LS74 edge-triggered D-type latches or flipflops 50, 52 and 54, each of which has a D input, a clock (CLK) input, a Q set output, and a $\overline{Q}$reset output. The outputs of the three latches are connected as six inputs to an 8-to-1 74LS151 multiplexer 56 to whose output Y are switched, under the control of the digital color signals B, G, R applied to its SELECT terminals A, B and C, respectively, individual ones of the eight phase-shifted color subcarriers appearing on the eight inputs of the multiplexer. The O input terminal of multiplexer 56 is grounded and represents the color black, and the white input is connected to +5 volts. The S (strobe) terminal of the multiplexer chip 56 is not used and is grounded. A 14.318 MHz clock signal from the system bus is applied to the CLK terminal of latches 50 and 52, and inverted and applied to the CLK terminal of latch 54. The system clock signal is also divided by four in a frequency divider 58 to produce the 3.58 MHz (actually 3.5795) NTSC color subcarrier signal. A delay of one clock period of the 14.318 MHz signal corresponds to a 90° phase shift of the 3.58 MHz subcarrier. One-half of the 14.318 MHz clock period thus corresponds to a 45° phase shift of the subcarrier. The Q or 0° phase output of latch 50 is applied to the D input of latch 52, and the Q or 90° delay output of latch 52 is applied to the D input of latch 54.

The subcarrier signal is synchronized by the rising edges of the clock signal. Because of the inherent delay between the inputs and the outputs of such D-type latches, the zero phase output of latch 50, for example, will be slightly delayed from its D input. Thus, when the Q output of latch 50 is applied to the D input of latch 52, it will not be up for the first rising edge of the clock signal which is also applied to latch 52. Thus, the outputs of latch 52 will be delayed by ninety degrees relative to those of latch 50. Similarly, a 45° phase shift occurs between the outputs of latches 52 and 54; that is, when the Q output of latch 52 goes high, the Q output of latch 54 will go high one-half of the 14.318 MHz clock period later to produce the 45° phase shift. The same operation occurs for the $\overline{Q}$outputs of latches 52 and 54.

Thus, and as indicated by the legends in FIG. 3, the two outputs of latch or flipflop 50 provide a 3.58 MHz color subcarrier signal at both, 0° phase shift (yellow, brown, burst) and also 180° phase shift (blue, bright blue). Latch 52 delays the 0° phase shift signal from latch 50 and provides a 3.58 MHz signal at 90° phase shift (red, pink) and at 270° phase shift (cyan, bright cyan). Latch 54 delays the 90° phase shift signal from latch 52 by 45° , and its outputs provide a 3.58 MHz signal at 135° phase shift (magenta, bright magenta) and at 315° phase shift (green, bright green).

The phase-shifted subcarriers at the output Y of multiplexer 56 are passed through a buffer 60 and a 2.2 K resistor to the summing node 62 connected to the base of an NPN emitter-follower transistor 64 whose emitter-resistor output contains the composite video color signal which is applied through R.F. modulator 13 to the input terminals of the TV receiver 14. Also connected to summing node 62 via corresponding buffers 66, 68 and 69 and corresponding summing resistors having ohmic values of 3.3 K, 13 K and 4.7 K are the −SYNC and −BLANK signals from the CRT controller 16 and the +INTENSITY (I) signal from the color video control circuit or multiplexer 32 of FIG. 1. It should be noted that the red, green, blue and intensity signals are forced low during blanking times. The OR gates 70 and 72 are used to select the 3.58 MHz 0° phase shift signal during BURST time to provide the color burst signal. The −SYNC signal is a composite of the horizontal and vertical synchronizing pulses. In the steady state condition, i.e. when the T.V. screen is black, the Y output is 0, −SYNC is 1, −BLANK is 1, and I is 0.

Following is a truth table showing the individual phase-shifted color signals which are outputted by multiplexer 56 for different combinations of the +BLUE, +GREEN and +RED signals on the multiplexer terminals A, B and C, respectively, and for I=0.

| Color | A | B | C |
|---|---|---|---|
| Black | 0 | 0 | 0 |
| Red | 0 | 0 | 1 |
| Green | 0 | 1 | 0 |
| Yellow | 0 | 1 | 1 |
| Blue | 1 | 0 | 0 |
| Magenta | 1 | 0 | 1 |
| Cyan | 1 | 1 | 0 |
| White | 1 | 1 | 1 |

When I=1, the complementary "brighter" colors are produced as stated above and illustrated in FIG. 2.

Thus, the circuit of FIG. 3 accurately and simply converts the computer-generated red, green, blue and intensity digital signals into a color composite video signal which is compatible with conventional TV receivers, and which is particularly useful in low cost data processing systems to provide a color computer interface to a low cost color television receiver using an RF modulator.

While there has been described what is at present considered to be the preferred embodiment of this invention, it will be obvious to those skilled in the art that various changes and modifications may be made therein without departing from the invention, and it is, therefore, intended to cover all such changes and modifications as fall within the true spirit and scope of the invention.

We claim:

1. A composite video color signal-generating circuit for generating a composite video color signal compatible with a television receiver designed according to the NTSC color system comprising:

means for providing a 3.58 MHz wave reference color subcarrier signal;

digital phase-shifting means for digitally converting said subcarrier signal into a plurality of individual phase-shifted subcarrier signals of identical frequency simultaneously present on corresponding individual output lines, each individual signal having a different predetermined phase shift relative to said reference subcarrier signal, and each phase shift representing a different color; and multiplexer means having inputs coupled to respective ones of said output lines, and responsive to coded digital signals, representing different desired colors, for selectively switching to an output terminal of said multiplexer means individual ones of the phase-shifted subcarrier signals in accordance with the coded digital signals.

2. A circuit as defined in claim 1 further comprising means, coupled to said multiplexer output terminal, for combining each individual phase-shifted subcarrier signal on said output terminal with television synchronizing and blanking pulses to form a composite video color signal.

3. A circuit as defined in claim 1 or 2 wherein said digital phase-shifting means comprises:

first, second and third flipflop circuits each having: (1) a data input terminal, (2) a clock terminal, and (3) first and second output terminals on which are produced output signals whose phases are shifted at 180° relative to each other;

means for applying a clock signal to the clock terminals of said first and second flipflops and an inverted form of said clock signal to the clock terminal of said third flipflop, said clock signal having a frequency which is the fourth harmonic of said reference color subcarrier signal;

means for applying said reference color subcarrier signal to the data terminal of said first flipflop thereby producing on said first and second output terminals of said first flipflop individual subcarrier signals having phase shifts of 0° and 180°, respectively;

means for coupling said 0° phase shift subcarrier signal to the data input terminal of said flipflop, thereby producing on the first and second output terminals thereof subcarrier signals having phase shifts of 90° and 270°, respectively; and means coupling the 90° phase-shifted subcarrier signal to the data input terminal of said third flipflop, thereby producing on the first and second output terminals thereof subcarrier signals having phase shifts of 135° and 315°, respectively;

said first and second output terminals of said first, second and third flipflops being connected to said individual output lines, respectively.

4. A circuit as defined in claim 3 further comprising means for supplying said coded digital signals as three signals representing the colors of blue, green and red, respectively, each signal having a logical value of either 1 or 0, such that the six individually phase-shifted subcarrier signals on said individual lines represent the colors, yellow, blue, red, cyan, magenta and green respectively.

* * * * *